United States Patent [19]

Bastide

[11] 4,006,689

[45] Feb. 8, 1977

[54] PYROTECHNICAL SAFETY RELAY

[75] Inventor: Robert Guy Emile Bastide, Toulon, France

[73] Assignee: Etat Francais, Paris, France

[22] Filed: July 29, 1975

[21] Appl. No.: 600,094

[30] Foreign Application Priority Data

Aug. 1, 1974 France ..... 74.26707

[52] U.S. Cl. ..... 102/70 R; 102/76 P; 102/77; 102/81; 102/85.6

[51] Int. Cl.[2] ..... F42C 15/20; F42C 9/10

[58] Field of Search ..... 102/70 R, 70 S, 76 R, 102/76 P, 81, 85, 85.6, 77, 78, 72, 16, 49.6

[56] References Cited

UNITED STATES PATENTS

| | | | |
|---|---|---|---|
| 678,367 | 7/1901 | Lynch et al. | 102/77 |
| 1,234,574 | 7/1917 | Schneider | 102/72 |
| 1,393,585 | 10/1921 | Sutton | 102/78 |
| 2,030,085 | 2/1936 | Woodberry | 102/76 P |
| 2,198,697 | 4/1940 | Driggs | 102/85 X |
| 2,704,033 | 3/1955 | Koeper et al. | 102/81 X |
| 2,755,738 | 7/1956 | Jones et al. | 102/78 |
| 2,838,999 | 6/1958 | Corsi | 102/72 |
| 3,371,608 | 3/1968 | Webb | 102/72 |
| 3,724,385 | 4/1973 | Beatty et al. | 102/78 X |

*Primary Examiner*—David H. Brown

[57] ABSTRACT

A pyrotechnical safety relay for controlling the firing of a main pyrotechnical charge carried by a projectile launched from a tube wherein the relay has a slidable finger mounted in a transverse bore in the projectile. The bore has a closed end and an opposite open end and the finger is normally retracted in the bore to allow the projectile to be ejected from the launch tube. At the time of discharge from the launch tube, a pyrotechnical charge in the relay is activated via transmission charges carried in the relay and th relay is displaced in the bore in the projectile to project from the open end of the bore. An abutment engages the relay to hold the same in its displaced position and in such position the flame front from the transmission charges is propagated to a pyrotechnical charge in the projectile serving as an illuminating or smoke marker.

8 Claims, 3 Drawing Figures

PYROTECHNICAL SAFETY RELAY

FIELD OF THE INVENTION

The present invention relates to a pyrotechnical relay serving as a security device preventing the firing of a main pyrotechnical charge carried by a projectiie or engine when the same has not left the launch tube.

BACKGROUND OF THE INVENTION

The technical field of the invention is that of engines containing pyrotechnical charges notably markers and smoke or illuminating cartridges launched from an aircraft to mark the location of a target in the water, for example, an enemy submarine or a boat in distress.

The pyrotechnical device, smoke or illuminating, launched from an aircraft to mark a target in the water can be launched by means of a rearwardly facing tube, for example, a pneumatic tube which imparts to the marker at the outlet of the tube a relative speed equal and in opposite direction to that of the aircraft such that the absolute speed of the marker is zero so that it will fall into the water at a vertical location below the point of launching. There can also be utilized as the tube, the barrel of the gun from which projectile is fired or any other means serving to contain and guide the projectile at the time of firing.

Problems are produced at the time of launching of such markers due to improper functioning of the propulsive system or an insufficiency of the propulsive charge whereby the marker has not left the tube and the pyrotechnical charge contained in the marker has been activated at the interior of the tube. This presents a grave danger to the launching aircraft.

There are known security arrangements intended to prevent the firing of the pyrotechnical charge when the projectile which transports it has not left the launch tube.

There is known, for example, arrangements comprising a spring-loaded finger which is ejected from its housing at the discharge of the projectile from the tube and which then actuates a delay device controlling the firing of the charge with a delay determined with respect to the passage of the projectile at the mouth of the launch tube.

The delay device is constituted, for example, by a receiver containing a divided product which travels in a determined time through an orifice which is opened by the ejection of the security finger. The divided product is constituted, for example, by balls.

Pyrotechnical delay relays are also known which control the detonation of a charge carried by the projectile with a determined delay with respect to the instance of commencement of the propulsion of the projectile, this being at the same time as when the relay is activated. The later arrangement does not offer any safety in the case when the projectile does not leave the launch tube.

There also exist primer delay relays whose activation is effected by the raising of a finger or by the acceleration imparted to the projectile.

SUMMARY OF THE INVENTION

An object of the present invention is to obviate the deficiencies of the known arrangements by means of a delay pyrotechnical relay which permits the pre-determination of a delay between the beginning of the launch and the instant when the main pyrotechnical charge will be fired, said relay also being a security arrangement positively preventing the firing of the main charge when the projectile is still in the launch tube.

This objective is attained by means of a pyrotechnical relay mounted on a projectile and comprising a finger slidable in a transverse bore in the projectile having one open extremity and one closed extremity, said finger having a longitudinal bind bore containing an auxiliary pyrotechnical charge and opening at the extremity of said finger situated adjacent the closed extremity of said bore in the projectile. The slidable finger is normally maintained in position by a security pin which is sheared under the effect of gas pressure coming from the combustion of the auxiliary pyrotechnical charge.

The longitudinal bore in the finger communicates on the one hand with a main transverse channel whose opening at the surface of the finger adjacent a primer for firing of the relay and on the other hand with a second transverse channel longitudinally offset with respect to the first whose opening at the surface of the finger is situated opposite the opening of the first channel.

The slidable finger has a longitudinal slot whose length is at least equal to the distance separating the transverse channels and a contact stud fixed with the body of the relay is disposed in the slot and constitutes an abutment for positioning of the movable finger after discharge from the launch tube such that the second transverse channel is placed adjacent a pyrotechnical charge transmitting the firing to the main pyrotechnical charge.

Preferably the contact stud is extended by said security pin.

The result of the invention is a novel product constituted by a pyrotechnical relay with a safety delay.

The advantages of this relay are the following:

The slidable finger has the function of an interrupter absolutely halting the transmission of the combustion to the main charge when the projectile has not left the tube. The conception of this interrupter guarantees that no false operation will be produced. The interrupter finger constitutes an unbreakable barrier between the primer and the main delaying charge. The flame front from the primer cannot pass the interrupter finger and penetrate into the space between the finger and its housing in the bore in the projectile.

The apparatus employs no spring or elastic device to displace the interrupter finger. This function is achieved by the pressure of the gas due to the combustion of an auxiliary pyrotechnical charge for better safety of operation.

The primer for firing the relay can be a primer fired by a percussion device activated by the pressure of the propulsion gas of the projectile, a compressed gas, or a gas produced by the combustion of a propulsive pyrotechnical charge. The apparatus according to the invention can be also equipped with a primer which is activated by electrical firing or by means of any other known detonator.

The relay according to the invention does not employ complex mechanisms and is easy to manufacture.

A first delay charge is inserted in the longitudinal bore in the interrupter finger such that the gas pressure acting to displace the interrupter finger normally is developed when the projectile has already left the tube.

Preferably, a second delay charge is placed in the second transverse channel to give a delay of the order of one second such that the interrupter finger has time to disengage and come adjacent the delay pyrotechnical charge which transmits the firing to the main charge.

A specific application is the control of the firing of markers and smoke or illuminating cartridges without the field of use being limited to this application.

A relay according to the invention can also serve as a security device in storage by providing a container packing for a rigid belt placed at the level of the interrupter finger.

The following description refers to the attached drawings which show an embodiment of a relay according to the invention without limiting characteristic.

DETAILED DESCRIPTION

Figure 1:
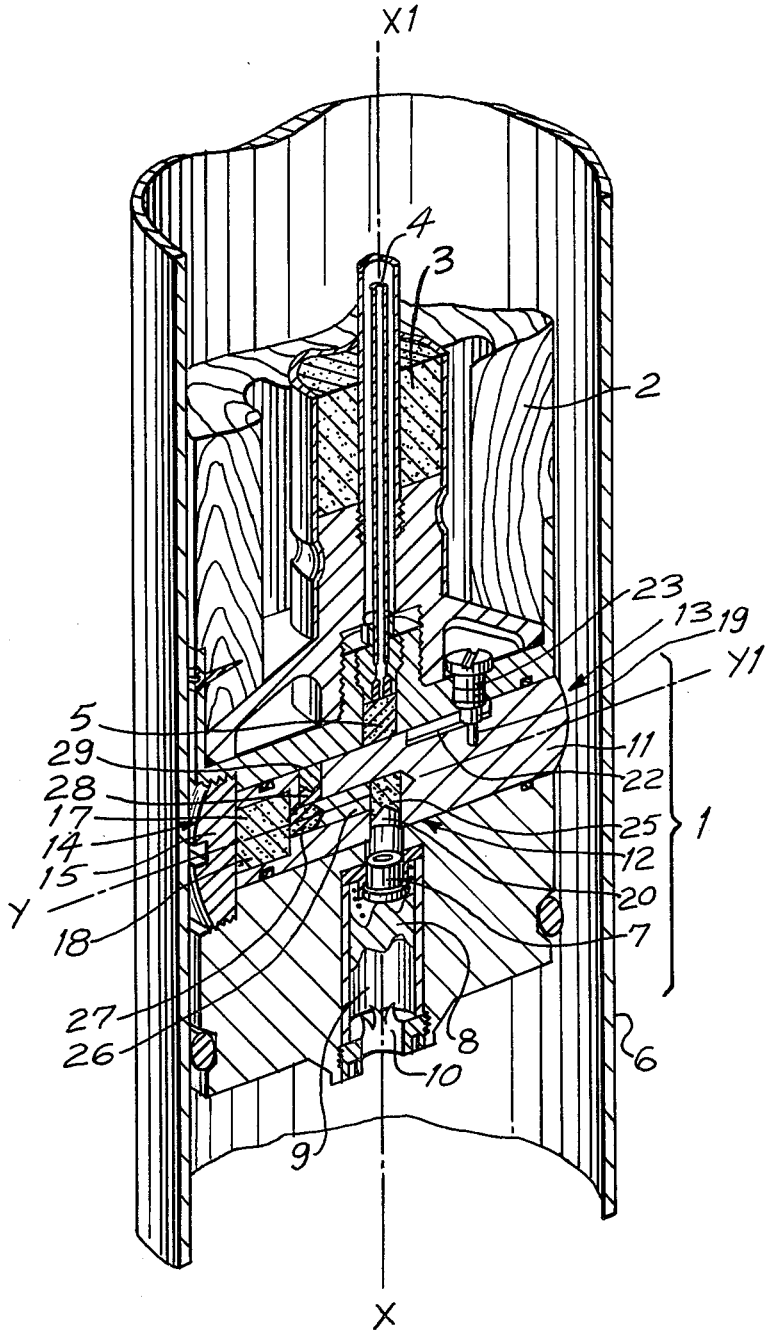
FIG. 1 is a perspective view in section of a relay according to the invention mounted on a projectile which is still in a launch tube.

FIG. 1 shows a safety pyrotechnical relay 1 mounted at the rear extremity of a projectile 2 only part of which has been shown. The projectile 2 can be, for example, a marker adapted to be launched into the water and carrying a main pyrotechnical charge 3 which can be a smoke charge or an illuminating charge. The projectile has a central conduit 4 at the base of which is placed a transmission pyrotechnical charge 5 which is highly exothermic and adopted to propagate the flame front coming from the rear to the front part of the projectile which is found to be the upper portion when the marker floats in the water.

The projectile is launched from a cannon or launch tube 6, for example, a tube provided at the rear of a pneumatic or pyrotechnical propulsion device.

The relay 1 comprises a primer 7 whose firing is effected by impact of a percussion device 8 which is impacted against the primer under the action of the pressure of the gas of the projectile. The percussion device is slidable in a housing 9 closed by a plug 10 which is ruptured under the pressure of the gas.

The relay 1 has the function of transmitting the flame front coming from the primer 7 to the rear extremity of the charge 5 with a determined delay under the condition that the projectile 2 has left the launch tube.

The relay 1 comprises a slide 11 forming a sliding finger in a transverse bore 12 extending along axis $Y—Y_1$ and having an open extremity 13. The other extremity 14 of the bore 12 is closed by a threaded stopper 15.

The term "transverse" is employed in a general sense. In FIG. 1 the bore 12 is perpendicular to the longitudinal axis $X—X_1$, of the projectile and in practice it is this disposition which is the simplest to obtain. However, it is obvious that the sliding finger will serve the same function if the bore 12 is oblique with respect to the longitudinal axis $X—X_1$, and the term "transverse" signifies both a perpendicularity to the axis $X—X_1$, or an oblique relation with respect thereto.

The finger 11 is provided with a blind longitudinal bore 16 which opens at the extremity situated adjacent the stopper 15. This longitudinal bore has at its extremity an enlargement 17 in which is placed an auxiliary pyrotechnical charge 18.

The finger 11 is maintained in place by a shearable security pin 19.

The finger 11 has a first channel 20 extending transversely to the finger which communicates with the longitudinal bore 16 and which has an outlet at the surface of the finger opposite the primer 7.

The finger 11 has a second transverse channel 21 which also communicates with the longitudinal channel 16 and which opens on the wall of the finger opposite the outlet of the channel 20. The channels 20 and 21 are offset from one another along axis $Y—Y_1$.

The finger 11 preferably has a circular section but obviously this shape is not obligatory and it could have any polygonal or oval section.

The bore 16 and channels 20, and 21 are preferably circular but can have any other section as well.

The finger 11 has a longitudinal slot 22 whose length is at least equal to the distance between the channels 20 and 21. In the slot 22 is disposed a contact stud 23 solid with body 24 of the relay. The stud 23 is prolonged by the security pin 19. In the longitudinal channel 16 there is disposed a first pyrotechnical charge 25 placed adjacent the channel 20 and fired by the flame front coming from the primer 7.

Axially disposed in bore 16 at the end of charge 20 is a delay pyrotechnical charge 26 introducing a delay in the propogation of the flame front of about one second. The charge 26 is placed in the portion of the bore 16 between the two transverse channels 20 and 21.

At the end of the charge 26 there is placed in the longitudinal bore 16 a charge 27 which transmits the firing to the auxiliary charge 18.

In the transverse channel 21 there is placed a delay pyrotechnical charge 28 introducing, for example, a delay of one second in the transmission of the flame front between pyrotechnical charges 26 and 29.

Figure 2:
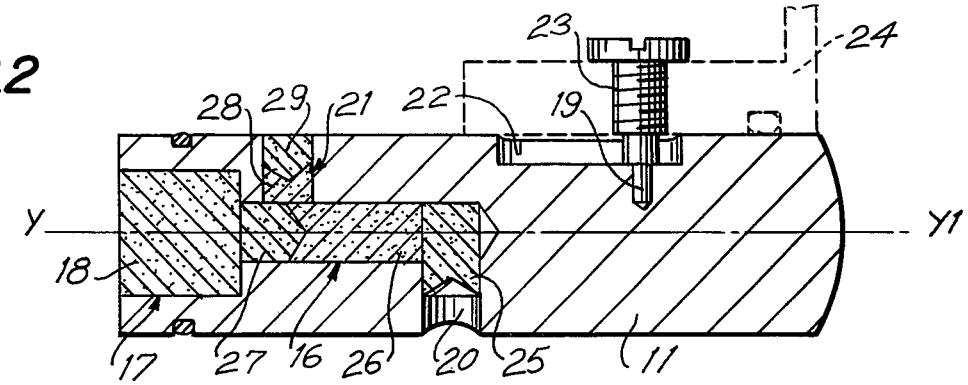
FIG. 2 is a side sectional view, on greater scale, of a slidable finger of the relay.

FIG. 2 is a transverse section on greater scale showing the left extremity of the sliding finger 11 and particularly the disposition of the delay pyrotechnical charges and the instantaneous pyrotechnical charges in the bore 16 and the channels 20 and 21.

It is seen that the delay charge 26 comes into contact with the charges 27 and 28.

Figure 3:
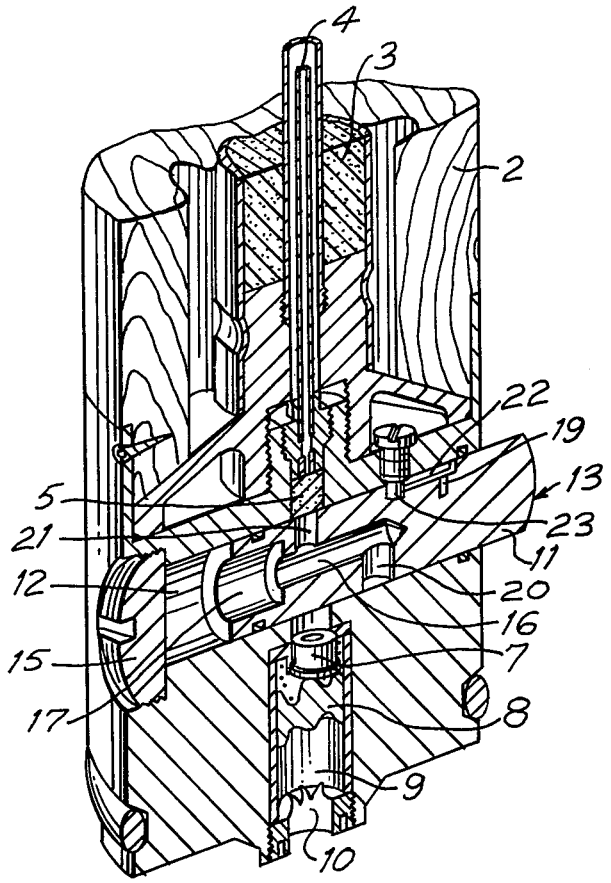
FIG. 3 is a perspective view in section of the same relay after the projectile has left the launch tube.

FIG. 3 is a section identical to FIG. 1 showing the position of the sliding finger 11 after the discharge from the launch tube.

The operation is as follows:

The projectile 2 is launched from a cannon or a launch tube 6 comprising a means for propulsion of the projectile, for example, a compressed air device or a pyrotechnical device. The pressure of the gas ruptures the closure plug 10 and projects the precussion device, which was maintained rearwardly by a spring, against the primer 7 to fire the same. The flame front from the thus fired primer 7 instantly ignites the transmission charge 25 which is adjacent the bottom of channel 20.

The charge 25 ignites the delay charge 26. During the burning of the charge 26 the projectile has normally left the launch tube. When the charge 26 has finished burning it simultaneously ignites the transmission charges 27 and 28.

The combustion of the charge 27 causes combustion of the auxiliary charge 18 which is composed, for example, of a black powder charge which produces a large release of gas. The pressure of the gas coming from the combustion of the charge 18 pushes the slidable finger 11 towards the open extremity 13 and shears the security pin 19.

If the projectile is effectively out of the tube 6, the finger 11 is displaced and comes into abutment against the contact stud 23 as shown in FIG. 3. In this position the channel 21 faces the central conduit 4 and the transmission charge 5.

While the finger 11 is being displaced, the delay charge 28 has burned and it transmits the flame front to the charge 29 which ignites the charge 5.

If the projectile has not yet left the tube while the charge 29 is burning, the finger 11 cannot slide and the flame front cannot be transmitted to the transmission charge 5 and therefore to the main charge 3, thereby preventing the firing thereof within the launch tube. The finger 11 serves the function of a safety interrupter for the relay.

Tests have shown that this safety is complete. It is impossible for the primer flame front to be transmitted to the charge 5 by encircling the interrupter finger and it is impossible for the interrupter finger to slide when the projectile has not left the launch tube.

The introduction of delay charges in the slidable finger has the advantage that the force for displacement of the finger is normally produced when the projectile has left the launch tube and the finger therefore slides freely without frictional contact with the walls of the tube. It is only in the case of an accident that the slidable finger can bear against the walls of the tube.

The presence of a second delay charge in the transverse channel 21 serves the purpose of allowing time for the finger 11 to slide before the ignition of the charge 29 such that when this is ignited it will be adjacent the charge 5. Of course, the value of the delay indicated has only been given by way of example and these delays could vary as a function of the size and speed of launch of the projectile.

It is understood without departing from the framework of the invention that various portions of the relay which have just been described could be replaced by equivalent elements well known to those skilled in the art.

What is claimed is:

1. A pyrotechnical safety relay for controlling the firing of a main pyrotechnical charge carried by a projectile launched from a tube, said relay comprising a finger slidable in a transverse bore provided in the projectile, said finger having an initial inoperative position and a displaced operative position, the bore having an open extremity and a closed extremity, said finger having a blind longitudinal bore containing an auxiliary pyrotechnical charge and an opening at the extremity of the finger situated adjacent said closed extremity of said transverse bore, means for igniting said charge in the blind bore with said finger in said initial inoperative position such that the finger is displaced to said operative position, and means for igniting the main pyrotechnical charge from the auxiliary pyrotechnical charge with the finger in displaced operative position.

2. A relay according to claim 1 comprising a security pin holding said finger in place in said inoperative position and shearable under the effect of the pressure of the gas developed by the combustion of the auxiliary pyrotecnical charge.

3. A relay according to claim 2 wherein said means for igniting the charge in the blind bore comprises a first transverse channel in said finger communicating with said longitudinal bore, said channel having an opening at the surface of the finger adjacent a primer in the projectile for actuating the relay, the means for igniting the main charge from the auxiliary charge comprising a second transverse channel longitudinally spaced with respect to the first channel and having an outlet at the surface of the finger opposite the inlet of said first channel.

4. A relay according to claim 3 wherein said pyrotechnical charge contained in the longitudinal channel of the slidable finger is a delay charge placed between the two transverse channels.

5. A relay according to claim 3 wherein said finger has a longitudinal slot whose length is at least equal to the distance between said transverse channels, a fixed contact stud in said slot consistuting an abutment for positioning of said finger after departure of the projectile from the launch tube such that the second transverse channel is placed in facing relation to a transmission pyrotechnical charge for transmitting the flame front to the main pyrotechnical charge.

6. A relay according to claim 5 wherein said contact stud is prolonged by said security pin.

7. A relay according to claim 3 wherein the second transverse channel contains a delay charge.

8. A relay according to claim 7 comprising a delay charge in the second transverse channel, and a second charge in said blind bore having instantaneous combustion, said delay charge contained in the longitudinal channel being placed in contact both with the delay charge placed in the second transverse channel and with said second charge for producing combustion of the auxiliary pyrotechnical charge, the latter being placed at the extremity of the longitudinal channel.

* * * * *